350-331 SR
PM012 XR 4,236,240

United States Patent [19]

Yoshida

[11] 4,236,240

[45] Nov. 25, 1980

[54] WATCH MODULE CONSTRUCTION

[75] Inventor: Masaru Yoshida, Tokyo, Japan

[73] Assignee: Citizen Watch Company Limited, Tokyo, Japan

[21] Appl. No.: 76,534

[22] Filed: Sep. 18, 1979

[30] Foreign Application Priority Data

Sep. 22, 1978 [JP] Japan ..... 53-116840

[51] Int. Cl.[3] ..... G04B 19/00; G04G 9/00; G04F 10/04

[52] U.S. Cl. ..... 368/76; 368/29; 368/30; 368/34; 368/84; 368/107

[58] Field of Search ..... 58/4 A, 4 R, 39.5, 50 R, 58/50 A, 52, 58, 59, 74, 85.5, 127 R, 152 R, 152 B; 340/323, 765, 784; 350/345; 362/29, 30

[56] References Cited

U.S. PATENT DOCUMENTS

| | | | |
|---|---|---|---|
| 3,357,703 | 12/1967 | Hurley | 58/152 R X |
| 3,668,861 | 6/1972 | Mitsui | 58/50 R |
| 3,945,191 | 3/1976 | van Berkum | 58/50 R |
| 4,165,607 | 8/1979 | Fedorowicz et al. | 58/50 R |

*Primary Examiner*—Edith S. Jackmon
*Attorney, Agent, or Firm*—Jordan and Hamburg

[57] ABSTRACT

A watch module construction including a liquid crystal display cell of a polygonal profile in plan, with one internal angle of the profile being in the range 180 degrees to 360 degrees, and an analog display device including time indicating hands. A cell support frame is disposed on one side of each of a base plate and a circuit board aligned substantially on the same plane as the base plate. The cell support frame has a first recess in which the liquid crystal display cell is disposed, and a second recess in which the time indicating hands are disposed. An IC chip is mounted on the other side of the circuit board in substantially axial alignment with the display cell, and a wheel train mechanism is disposed on the other side of the base plate in substantially axial alignment with the time indicating hands.

17 Claims, 13 Drawing Figures

WATCH MODULE CONSTRUCTION

BACKGROUND OF THE INVENTION

This invention relates to an electronic timepiece, and more particularly, to a quartz wristwatch including an analog display mechanism that makes use of time-indicating hands, and a digital display mechanism employing electro-optical means such as a liquid crystal display cell.

Owing to advancements in the field of electronics technology the timepiece market, which until recently was dominated by the traditional analog-type watches that employ time-indicating hands, is now seeing the appearance of digital timepieces that rely on electro-optical display means such as LED's and liquid crystal display cells. These digital timepieces have come to occupy a large share of the market because of their multiple functions, convenience, ease of use, low cost, reliability, design, etc. Nevertheless, analog timepieces are still superior to those of the digital type in view of the wide variety of designs which are available, their high sense of fashion, as well as the ease with which they can be read.

SUMMARY OF THE INVENTION

It is, therefore, an object of the present invention to provide, at low cost, a quartz wristwatch equipped with both an analog display mechanism that makes use of time-indicating hands, and a digital display mechanism employing a liquid crystal display device, thereby making it possible to combine the best features of analog and digital displays and compensate for their shortcomings in order to furnish a wristwatch which is characterized by its numerous functions, outstanding design, ease of use and excellent readability.

DETAILED DESCRIPTION OF PREFERRED EMBODIMENTS

Figure 1:
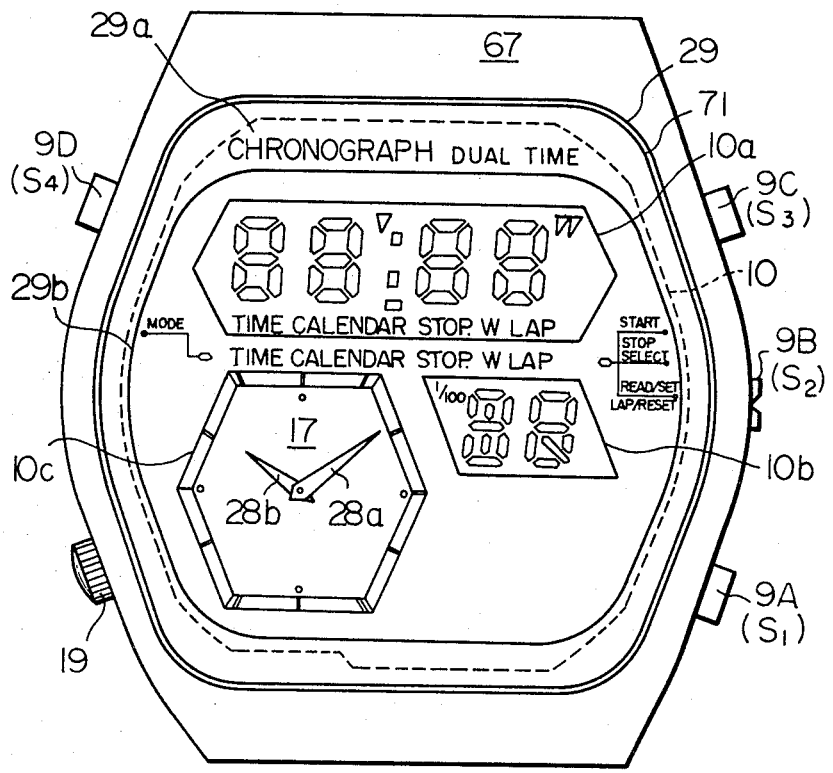
FIG. 1 is a top view of an encased electronic timepiece according to the present invention.

FIG. 1 is a top view of an encased electronic timepiece according to the present invention. A crystal glass 29 is mounted in a case 67 through a packing 71. The inner surface of the crystal glass 29 is subjected to a printing technique to form characters 29*a* and a masking portion 29*b* which are arranged to cover the outer circumference of a masking or decorative plate 10 upon considering overall design. Masking plate 10 includes three openings or frames 10*a*, 10*b* and 10*c* formed at first, second and third areas of the masking plate 10, respectively, the upper opening 10*a* and lower opening 10*b* on the right serving as windows for digital displays, and the lower opening 10*c* on the left serving as a window for an analog display. The functions of push-buttons 9 and the digital display modes as well as other items of information are printed on the masking plate 10.

Disposed within the upper opening 10*a* is a display section which is composed of four, seven-segment digits as well as such indications as TIME, CALENDAR, STOP. W and LAP, and marks such as " : ", " — ", " ' " and " " ". Positioned within the lower opening 10*b* is a display section which is composed of two, 8- and 9-segment digits as well as an indication "1/100". The opening 10*a*, 10*b* thus arranged constitute the digital display portion of the timepiece and allow the time to be read therethrough. The lower opening 10*c* allows the analog display section to be viewed and presents an analog display of time by means of two time-indicating hands, namely an hours hand 28*b* and minutes hand 28*a*, in cooperation with a dial 17.

The setting and adjustment of the time is carried out by means of four push-buttons 9A, 9B, 9C and 9D and a crown 19. In principle, the digital display portion and analog display portion are set and adjusted independently of each other, with the four push-buttons 9A, 9B, 9C and 9D being used to set and correct the former and the crown 19 the latter. The setting and adjustment of the digital and analog display portions follows the conventional method and can therefore be easily understood and carried out.

When the timepiece is in the normal operating mode the digital display sections seen through the openings 10*a* and 10*b* present a display of time, with the segments of the four digits in the upper opening 10*a* displaying hours and minutes, and the segments of the two digits in the lower opening 10*b* displaying seconds. In this case the TIME and colon (" : ") marks are displayed. A 24-hour system is adopted for the hours display (i.e., a display from 1 to 23), while the analog dipslay in opening 10*c* is a 12-hour clock. Combining both displays in this manner is extremely convenient since the time can be directly read in terms of either a 12-hour or 24-hour system. Depressing push-button 9A ($S_1$ in the drawing designating a switch interlocking with the push-button) changes over the display from the normal to the calendar mode so that the display section in upper opening 10*a* displays month and date while the lower opening 10*b* displays the day of the week. Hence, the CALENDAR and " — " marks appear. The day of the week display is formed by the two 8- and 9-segment digits which display the first two letters of the English words, and is thus similar to the system adopted in conventional digital timepieces. Since the analog display opening 10*c* continues to display time while the digital display openings 10*a* and 10*b* display calendar information, the timepiece is extremely convenient because such a combination of displays allows almost all necessary time information to be directly read. Moreover, since the timepiece can be made to store years information when the calendar is in the correction mode, a perpetual calendar can be realized that not only discriminates between 28, 30 and 31-day months but leap years as well. Hence, unlike the conventional analog timepieces equipped with a mechanical calendar, there is no need for a troublesome date correction at the end of the 28 and 30-day months. The adoption of the mechanical mechanism for the calendar in the conventional analog timepieces makes it extremely expensive and complicated to realize an accurate perpetual calendar capable of discriminating among 28, 30 and 31-day months and leap years. Attaining such a calendar through the mechanical approach may not be possible.

The present invention makes it possible to realize, at low cost, a highly reliable perpetual calendar which, after a simple initial setting, requires absolutely no correction until the timepiece completely stops operating, this feature being attained by making combined use of the easily readable, familiar analog display for displaying time and an electro-optical display mechanism for the display of calendar information.

A time correction is performed by first depressing push-button 9B ($S_2$ in the drawing designating a switch interlocking with the push-button) to select the digit to be corrected, and then by depressing push-button 9A to close switch $S_1$ and hence effect the correction of the selected digit which appears as a flashing digit on the digital display. The correction sequence starts with the seconds display and then advances to the minutes, hours, month, date, day of the week and years display in the order mentioned. The TIME mark is displayed until the correction sequence reaches the months display; the CALENDAR mark is displayed thereafter. The seconds correction consists of resetting the seconds information to zero. When this correction is effected with the seconds display reading between 00 and 29 seconds, the numerals being displayed are discarded and returned to 00 without a carry to the minutes display. If the correction is performed with the seconds display reading between 30 and 59 seconds, there is a carry operation with 1 being added to the minutes display at the same time that the seconds display is restored to 00. With the exception of the seconds display all other digits which have been caused to flash by depressing the push-button 9A are corrected by adding 1 thereto, and no carry is provided to the next higher digit. When the year is corrected all marks other than the CALENDAR mark vanish and the last two digits of the dominical year are displayed in the lower opening **10*b***. When these two digits are divisible by 4 a leap year is detected so that a 29th day will be displayed in the month of February for that year.

Push-button 9C ($S_3$ in the drawing designating a switch interlocking with the push-button) is provided to activate a lamp and restore the digital display from the correction mode to the normal mode.

Depressing push-button 9D ($S_4$ in the drawing designating a switch interlocking with the push-button) changes over the normal display or calendar display to the display for a stopwatch mode. When the timepiece is placed in this mode, minutes and seconds as well as the STOP. W., " ' " and " " " marks are displayed in the upper opening **10*a*, while the 1/100 unit of second and 1/100 unit of second indication marks are displayed in the lower opening 10*b*. Push-button 9C now acts as a START/STOP button, and push-button 9A a LAP/RESET button. Depressing the push-button 9C to initiate stopwatch action causes the " '." " marks to flash and thus give an indication that the stopwatch function is in operation. Depressing push-button 9C again under these conditions halts the stopwatch and leaves the " '." " marks lit but in a non-flashing state. Repetitive operation of push-button 9C thus makes it possible to add elapsed time. In a game it is therefore a simple matter to measure net time, that is, game time minus loss time and rest time. With the stopwatch in the halted state, depressing push-button 9A** resets the display to

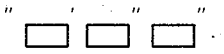

On the other hand, when the stopwatch is running, depressing push-button 9A activates the lap time display and displays the LAP mark. In this case the " '." " mark continues to flash, thus indicating that the stopwatch is still running. Depressing the push-button 9A a second time erases the LAP mark and cancels the lap measurement, restoring the stopwatch display to that for measuring elapsed time. The lap time feature is convenient not only for measuring elapsed time during races or the like but, when used in combination with the elapsed time feature of the stopwatch, also allows, by way of example, the records of the first and second finishers in a race to be simultaneously measured from the same starting time. More specifically, assume that push-button 9C has been depressed to start the stopwatch. As the stopwatch runs, first push-button 9A is depressed to measure the record of the first finisher, and then push-button 9C is depressed to measure the record of the second finisher. In this case the record of the first finisher is displayed as lap time. Depressing push-button 9A cancels the lap time so that the record of the second finisher is displayed as the elapsed time measured by the stopwatch. In an era where sports events are now timed to from 1/10 to 1/100 of a second, it is almost impossible for analog displays to make such measurements because of the error involved in reading such displays. With the timepiece of the present invention, however, ordinary time is read from the analog display portion which the wearer is normally accustomed to using, while the digital display portion is employed to accurately measure time in sports events or the like. Combining two such features into one timepiece renders the timepiece of the invention both convenient and easy to use.

Thus, the timepiece of the present invention does not merely combine an analog display and a digital display but allows the digital display to be used as a time and calendar display and as a stopwatch having a lap function. A large number of functions can therefore be incorporated in a single timepiece. However, a large increase in the number of functions can complicate timepiece operation and make it difficult to use. Hence, to simplify operability the timepiece of the present invention makes use of a traditional crown 19 to correct the analog display. Pulling out the crown one step and then rotating it to the left or right corrects the hands **28*a*, 28*b* as in the customary system. This method of correction is extremely easy to understand and is in such widespread use that almost no instructions are required. Moreover, the setting and correction of the digital display is simplified by dividing the use of the four push-buttons 9A, 9B, 9C and 9D** according to function, thus making it possible to avoid repeated manipulation of the same push-buttons or manipulations required for selecting desired functions (such as simultaneously depressing a number of push-buttons in combination or holding push-buttons depressed for a predetermined number of seconds). In addition, providing the display panel with a large number of marks is intended to let the wearer know, at a glance, exactly what is being displayed at any given moment.

Figure 2:
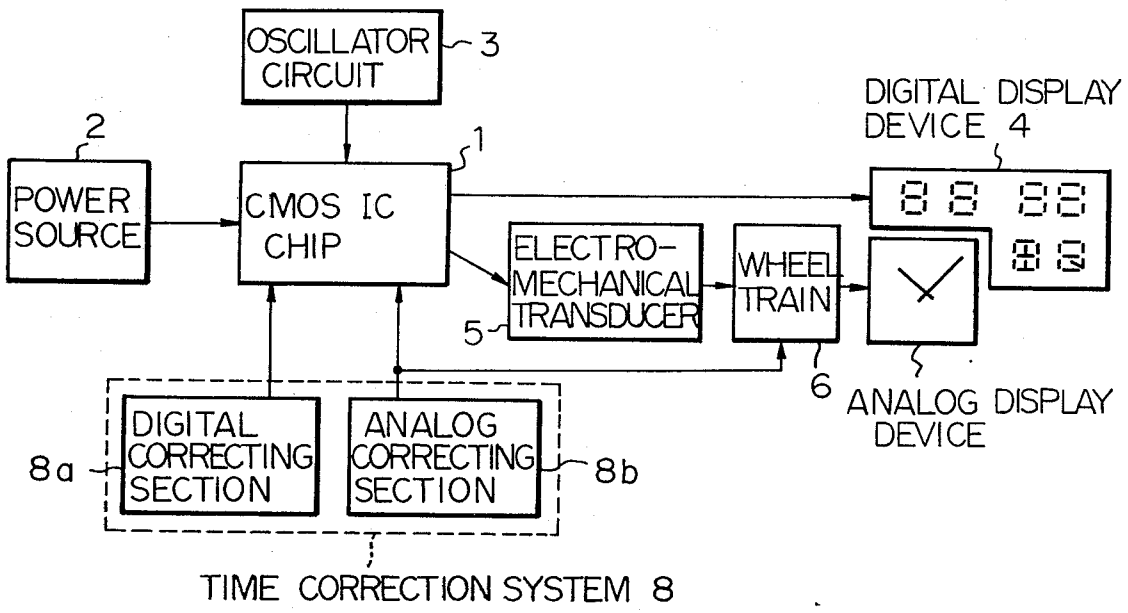
FIG. 2 is a block wiring diagram showing the construction of an electronic timepiece according to the present invention.

FIG. 2 is a block wiring diagram showing the construction of an electronic timepiece in accordance with the present invention. Reference numeral 1 designates a CMOS IC chip composed of an amplifier for an oscillator circuit, a frequency divider circuit, a time-keeping circuit, control circuit, booster circuit, decoder circuit, driver circuit for a liquid crystal display cell, and a driver circuit for an electro-mechanical transducer. The CMOS IC chip, with the exception of a voltage-boosting capacitor chip, exhibits a high reliability and low cost while consuming little electric power. Reference numeral 2 denotes a power source block that supplies electric power to the circuitry 1. A long battery lifetime can be attained by using a battery with a high energy density such as a small, button-shaped silver, mercury or lithium battery. An oscillator block 3 is composed of such components as a miniature quartz crystal vibrator, a miniature trimmer capacitor for adjustment of frequency, and a capacitor for temperature compensation. Reference numeral 4 designates a digital display device employing electro-optical display means such as LED's a liquid crystal display panel or an electrochromic device, etc. At the present time the liquid crystal panel exhibits the most outstanding characteristics in view of its cost, power consumption, readability, lifetime and reliability. Designated at 5 is an electro-mechanical transducer such as a stepping motor which is operable in response to driving pulses delivered by the circuitry 1 to generate a magnetic field which is in turn converted into the turning motion of a rotor or the like for transmission to a wheel train 6.

The wheel train 6 mechanically reduces the turning motion and displays time in an analog manner in an analog display section 7 by means of hours, minutes and seconds hands, etc. A time correction system 8 is divided into a correcting section 8*a* for the digital display section 4 and a correcting section 8*b* for the analog display section 7. The digital correcting section 8*a* is composed of push-buttons or the like and in principle corrects the display of the digital display section 4 by delivering electric correction signals to the control circuit included in the circuitry 1. The analog correcting section 8*b* is composed of such so-called setting components as a crown serving as an external operation member, a winding stem, clutch wheel, setting wheel, minutes wheel, clutch lever and setting lever spring, etc. This correction section mechanically corrects the hands and, at the same time, corrects the time-keeping circuit and controls the driver circuit for the transducer by actuating a reset lever or the like which, in cooperation with the setting components, sends an electric correction signal to the control circuit in the circuitry 1. Specifically, pulling out the crown to place it in a condition to rotate the timepiece hands resets a portion of the time-keeping circuit and interrupts the output from the driver circuit for the transducer.

Providing the digital display device 4 and analog display device 7 with their own independent correction sections 8*a* and 8*b* allows these display devices to be easily understood and operated since the methods of correction are in line with the methods used in the conventional digital and analog timepieces. The correction procedures for the analog display device 7 and digital display device 4 are linked only for the seconds correction and are not linked at any other time. The provision of the analog and digital correcting sections 8*b* and 8*a* for the respective analog and digital display devices 7 and 4 is thus intended to simplify timepiece operation and furnish the timepiece with a dual-time capability wherein the analog and digital display devices 7 and 4 present entirely separate time information. For example, the timepiece can be used by setting the digital display device 4 to Japan time and the analog display device 7 to the local time of a travel destination. In such a case the digital display device 4 would be left intact and only the analog display device 7 would require correction. In other words, the digital and analog time displays must be capable of being set independently without linkage in order to provide such a feature.

If the timepiece is used in such a manner that the digital display 4 and analog display 7 display the same time, it may indeed be more convenient to link their correction systems because both displays could then be set at once. However, since electronic timepieces with quartz crystal vibrators are accurate to within several seconds per month, there is almost no need to correct the time information units smaller than the minutes units during daily use. Hence, performing the seconds correction once every several weeks or once every several months allows the time to be maintained and read with sufficient accuracy. Conversely, however, maintaining an accurate indication of the time does require the seconds correction. The timepiece of the present invention therefore does correct the analog display 7 in linkage with the seconds correction of the digital display 4 but in the case of the seconds correction only. The reason for this feature is that the digital display 4 and analog display 7, which includes a second hand, would have to be corrected independently if there were no linkage between the analog and digital correction systems. This would be troublesome and make it difficult to attain perfect coincidence between the seconds information presented by both displays. Absence of linkage, even if the analog display 7 has only a minute and hour hand, would give rise to a discrepancy between the indications of the digital and analog displays 4, 7 caused by correcting the seconds information on the digital display 4. If this discrepancy is the result of only a single seconds correction on the order of several seconds it may be negligible because the minute hand would be shifted by only a very small angle; however, as timepiece error is generally decided by the initial setting, repeated seconds corrections of the digital system would compound the discrepancy indicated by the analog display 7 until the discrepancy is no longer negligible. This would occur because each initial setting would tend to move the minute hand too much or not enough. In this case, as in the case of the analog display provided with the second hand, the analog display 7 could be corrected simultaneously with the digital display 4, but effecting a correction of several seconds by adjusting the hands of a two-hand analog display is a troublesome operation. Even when the digital display 4 and analog display 7 are employed as a dual-time timepiece displaying entirely separate times, the correction of the analog display may be made concurrently with the seconds correction of the digital display.

This feature of making the corrections of the analog display 7 and digital display 4 in the case of the seconds correction but not in the case of corrections of minutes or larger units can be considered to be equivalent to dividing the correction function into a "setting" function which corrects for time differentials and a "correcting" function which corrects for timing errors resulting from errors in the oscillation frequency of the quartz crystal vibrator, there being no linkage between the analog and digital displays in the "setting" function but only in the "correcting" function.

Figure 3:
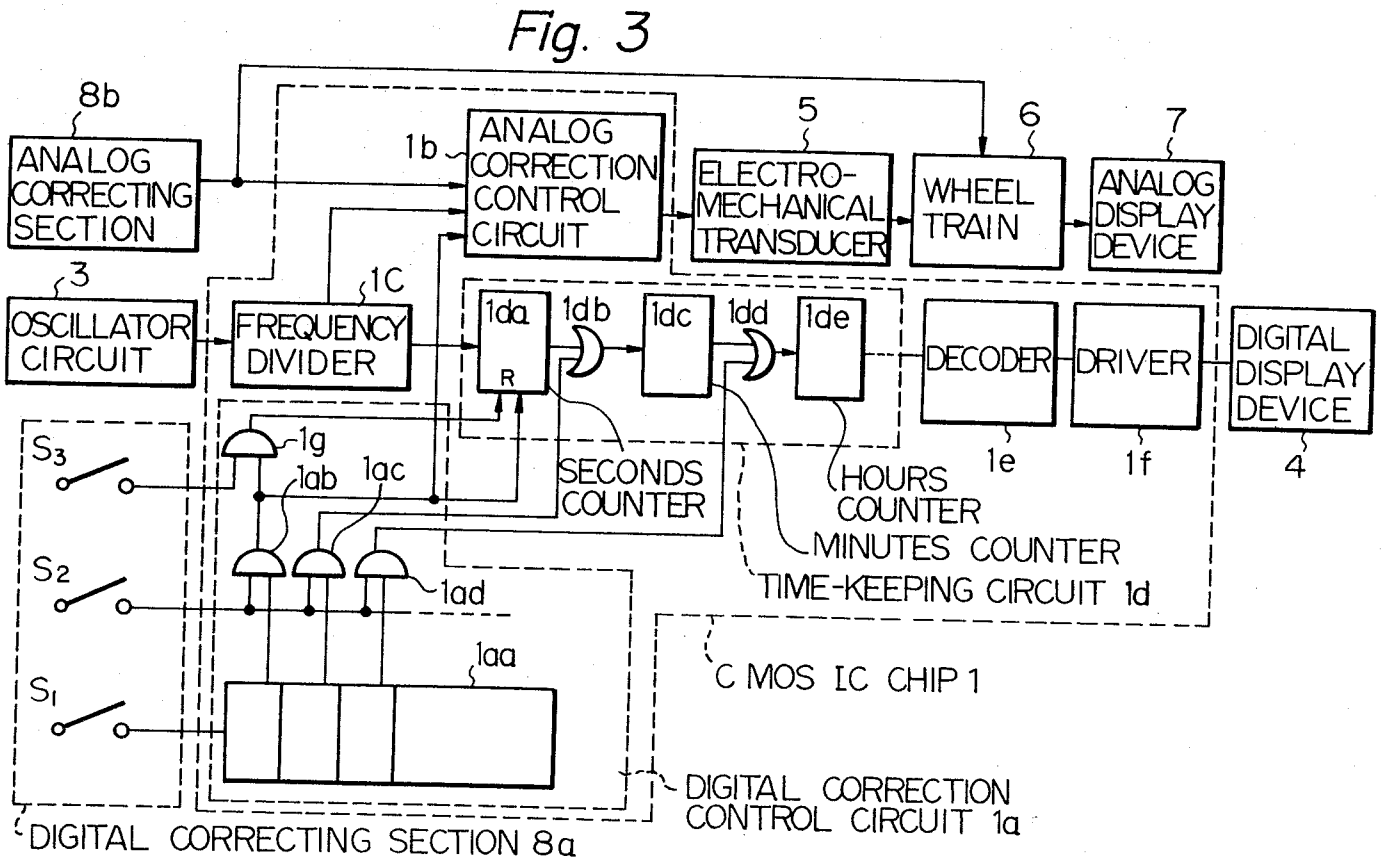
FIG. 3 is a block wiring diagram useful in describing the zero-reset system of the electronic timepiece according to the present invention.

FIG. 3 is a block wiring diagram which is useful in describing the abovementioned operating relationship between the analog and digital displays. The components that make up the circuitry block 1 illustrated in FIG. 2 are shown, and the digital correcting section 8*a* is shown to be composed of switches $S_1$, $S_2$ and $S_3$. The circuitry block 1 includes a digital correction control circuit 1*a* for the digital correcting section 8*a*. A shift register 1*aa*, in response to the number of operations of the switch $S_1$, selects digits which are to undergo a correction and sends signals, resulting from operation of switch $S_2$, to a timekeeping circuit 1*d* through AND gates 1*ab*, 1*ac*, . . . , the shift register 1*aa* being made to select the seconds correction state by a signal resulting from a first operation of the switch $S_1$. Closing switch $S_2$ under these conditions allows a signal to be directed through AND gate lab and applied to the reset terminal R of a seconds counter 1*da* in the time-keeping circuit 1*d*. This signal resets the seconds counter 1*da* and is simultaneously delivered to an analog correction control circuit 1*b* to effect control of analog output signals that are fed to the transducer 5. If the seconds counter 1*da* receives the reset signal when the count is between 0 and 29 seconds, the analog correction control circuit 1*b* interprets this as meaning that the timepiece is "fast" and halts its analog output for a period of time equivalent to the count. On the other hand, if the reset signal arrives when the count is between 30 and 59, this is interpreted as meaning that the timepiece is "slow" so that the analog correction control circuit 1*b* delivers to the transducer 5 an analog output signal sufficient to rapidly advance the transducer by the amount needed to give 60 seconds. By way of example we will consider a timepiece whose analog display section 7 advances by one-second steps. If the digital display section 4 reads 15 seconds at the time that the display is reset to zero, the analog output from the analog correction control circuit 1*b* will be interrupted for 15 seconds at the moment the digital display section 4 changes over to 00 seconds (i.e., the advance of a second hand, if one is provided, will be interrupted). Similarly, if the digital display section reads 40 seconds at the time that it is reset to zero, the digital display section will change to 00 and 1 minute will be added to the minutes digit and, in concurrence therewith, the analog correction control circuit 1*b* will produce an analog output signal consisting of 20 pulses constituting a high-speed advance signal having a frequency of between 8 and 32 Hz. Thus, if the analog display 7 and digital display 4 are in coincidence at the time of an initial setting, there will be no discrepancy between the two displays regardless of how many times the seconds correction is repeated. While this feature has been described in connection with a display having a second hand advancing at one step per second intervals, the results would be the same even if the display means or hand advance interval were changed.

A signal resulting from the second operation of switch $S_1$ causes the shift register 1*aa* to select the minutes correction state. Operating switch $S_2$ under these conditions sends a signal through AND gate 1*ab* and an OR gate 1*db* to a minutes counter 1*dc* to change the minutes display of the digital display section 4 in accordance with the number of times switch $S_2$ is operated. In this case there is no linkage between the analog and digital displays because the foregoing operation has no effect upon the analog correction control circuit 1*b*. The analog display section 7 thus remains unaffected by the digital correction for the subsequent hours or higher order corrections.

The method of initially setting the analog and digital display sections 7 and 4 is as follows.

In the timepiece of the present invention there is no linkage between the digital and analog displays 4 and 7 except in the case of a seconds correction, and the correction sections 8*a* and 8*b* are provided independently of each other. The initial setting of all time information other than the seconds information can therefore be easily carried out. The initial setting of the seconds information is such that the analog display 7 is set to the digital display 4 and then started. In other words, as will be described in more detail later, the analog correction section 8*b* is operated by a crown in the same manner as common analog-type electronic timepieces. With the crown 19 pulled out by one step a control signal is delivered to the analog correction control circuit 1*b* to interrupt the issuance of the analog output signal. Turning the crown under these conditions rotates the wheel train 6 so that the analog display section 7, namely the time-indicating hands 28*a* and 29*b*, can be set to a desired position. Since the second hand is at rest with the crown 19 pulled out by one step, depressing the crown at the instant of coincidence between the seconds display of the digital display section 4 and the second hand causes the second hand of the analog display section 7 to start. This completes the initial setting of the analog and digital display sections 7 and 4. If no second hand is provided the position of the minute hand of the analog display section 7 need only be carefully set to the reading of the digital display section 4.

Depressing switches $S_2$ and $S_3$ simultaneously also permits the digital display section 4 to undergo a seconds correction without linkage to the analog display section 7. This is to make it possible to set the digital display section 4 to the analog display section 7 which has been set in advance, and is intended to simplify the initial setting procedure as well as a logic test of the circuitry 1. When the switches $S_2$, $S_3$ in FIG. 3 are closed simultaneously, a signal issues from AND gate 1*g* and is delivered to the reset terminal R of seconds counter 1*da* to reset the counter to zero. If the purpose of this signal is limited to a mere logic test of the circuitry 1, the signal upon emergence from the AND gate 1*g* would be applied not only to the seconds counter 1*da* but also to the reset terminals of the minutes counter 1*dc*, hours counter 1*de* and all subsequent counters to enable all of these counters to be reset. In any case, the signal is intended for a "setting" and not a "correcting" purpose so that the analog display 7 is not linked to the correction operation for the digital display 4.

Thus, as set forth above, a correction corresponding to the "correcting" function, as when the digital display device 4 is reset to zero, is accomplished with linkage to the analog display section 7, whereas a correction corresponding to the "setting" function, as when the digital display section 4 is initially set or corrected for a time differential, is carried out with no linkage to the analog display section 7. Conversely, the correction of the analog display section 7 is not linked to the digital display section 4 regardless of either the "correcting" or "setting" function. It is therefore possible through an extremely simple mechanism and a readily understandable method to initially set the analog and digital display sections 7, 4 and attain the linkage mechanism. This has major practical effects.

It should also be noted that the initial setting of the digital and analog display sections 4, 7 can be greatly facilitated not only by the zero reset operation which is linked to the analog display 7 but by the added alternative of the zero reset operation which has no linkage with the analog display 7.

The remaining components in FIG. 3 are a frequency divider 1*c*, a decoder 1*e*, and a driver 1*f*.

Figure 4:
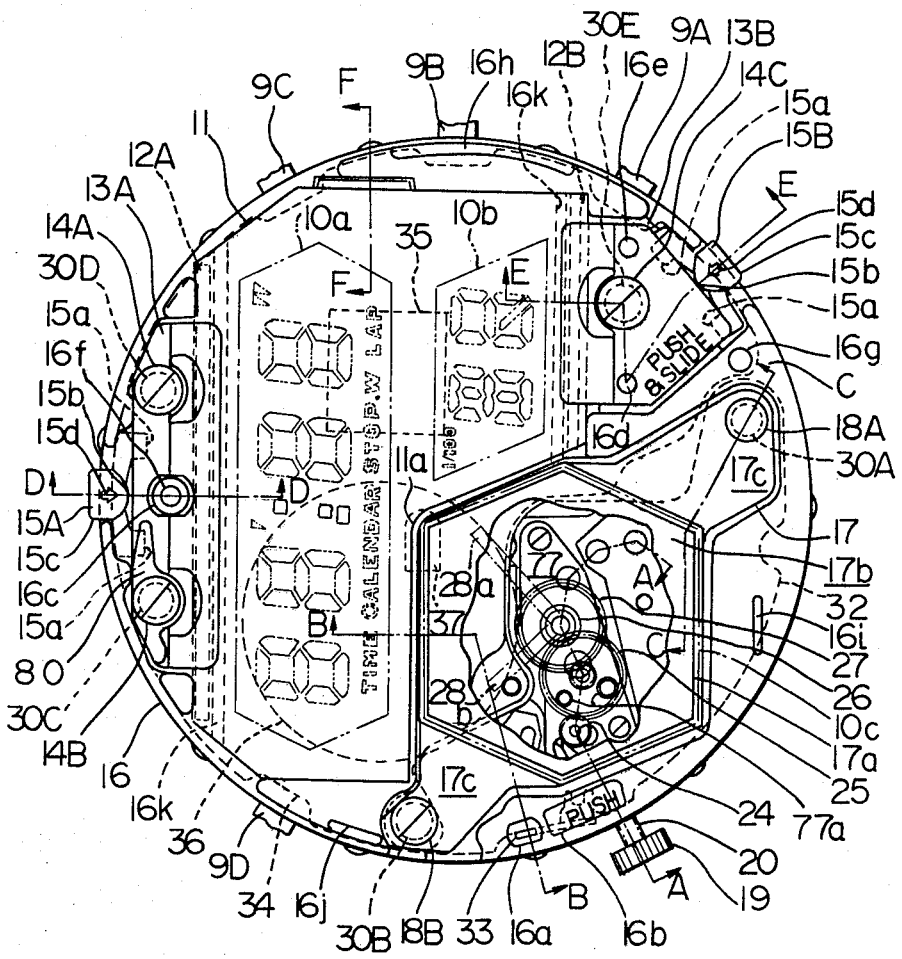
FIGS. 4 and 5 are top and bottom plan views, respectively, showing the construction of the timepiece in the assembled state.
Figure 5:
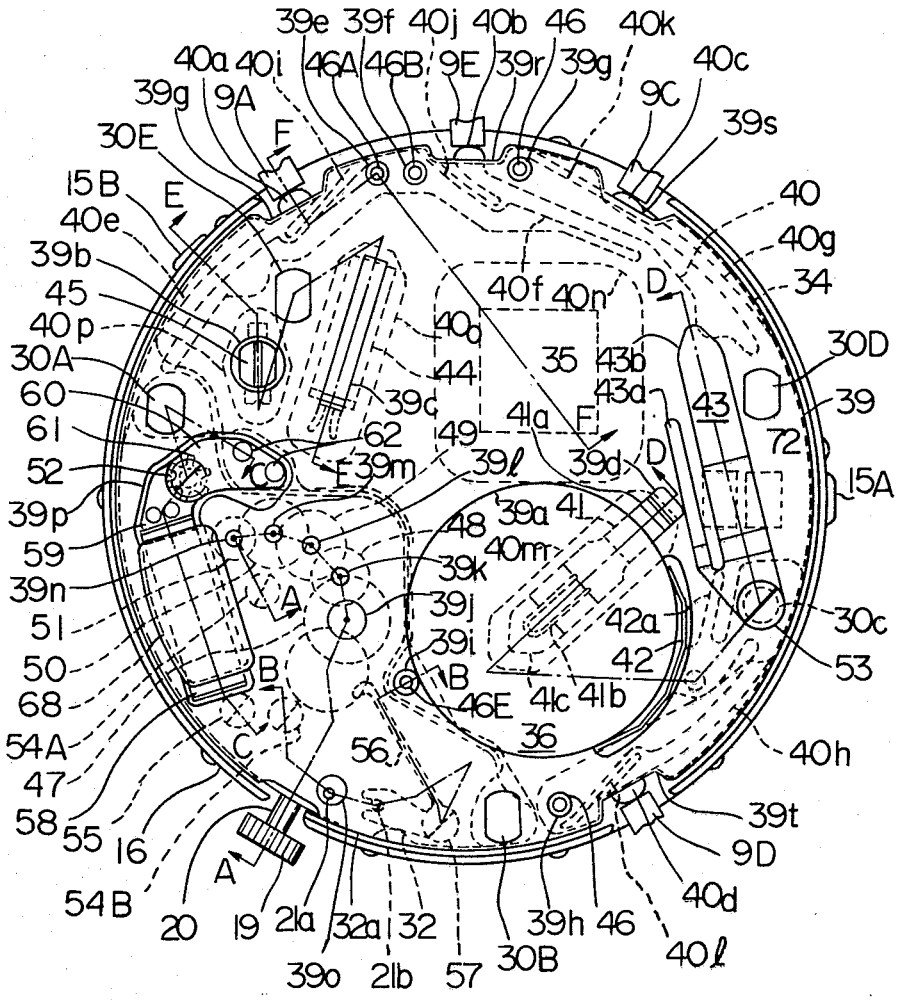

FIGS. 4 and 5 are plan views of the present invention in the assembled state, with FIG. 4 showing a top view (as viewed from the display side) and FIG. 5 showing a bottom view (as viewed from the back cover side). FIGS. 6, 7, 8, 9, 10 and 11 are cross-sectional views taken along the lines A—A, B—B, C—C, D—D, E—E and F—F, respectively, of FIGS. 4 and 5. The cross-sectional portions of the upper view (FIG. 4) and lower view (FIG. 5) differ because the upper and lower sides of the timepiece are divided by a boundary defined by a circuit board 34 or base plate 32.

The structural characteristics of the module contained in the timepiece of the present invention will now be described in connection with the assembly procedure.

Referring now to FIG. 5, a device cover 39 made of molded plastic is provided with a number of openings such as a battery accommodating portion 39*a* for receiving a battery 36 from the top side, an adjustment hole 39*b* for a trimmer capacitor 45, an access hole 39*c* for a quartz crystal vibrator 44, a positioning hole 39*d* for a battery retaining spring 41, access holes 39*e*, 39*f*, 39*g*, 39*h* and 39*i* for respective switch terminals 46A, 46B, 46C, 46D and 46E, peep holes 39*j*, 39*k*, 39*l*, 39m and 39*n* for the shafts of a center wheel and pinion 47, third wheel and pinion 48, fourth wheel and pinion 49, fifth wheel and pinion 50 and rotor 51, respectively, an adjustment hole 39*o* for a setting lever shaft 21*a*, and an access hole 39*p* in the vicinity of a coil terminal connection screw 52. The peep holes 39*j* through 39*n* for the respective shafts of the wheel train are provided to permit confirmation of shaft lubrication. In particular, the peep hole 39*j* for the center wheel and pinion 47 allows the upper end of the pinion shaft 47*a* to receive a jig in order to prevent deformation or denting of the base plate 32 or wheel train bridge 31 at the time that the hands of the timepiece are mounted, this arrangement being best shown in FIG. 6. Peep hole 39*j* is larger in diameter than the other peep holes.

The device cover 39 serves as the base of the module as is therefore the base on which both the digital and analog sections are assembled and secured. Covering the analog portion with the device cover 39 is extremely effective in preventing the electro-mechanical transducer, wheel train and other such mechanisms from the invasion of dust which would otherwise tend to jam or cause other malfunctions in these mechanisms. Moreover, covering a coil portion 58 with the device cover 39 is useful in preventing the windings of the coil 58 from being accidentally broken during handling. It is also possible to readily secure a magnetic shielding plate 68 to the device cover 39 by heat caulking or a similar method.

Figure 9:
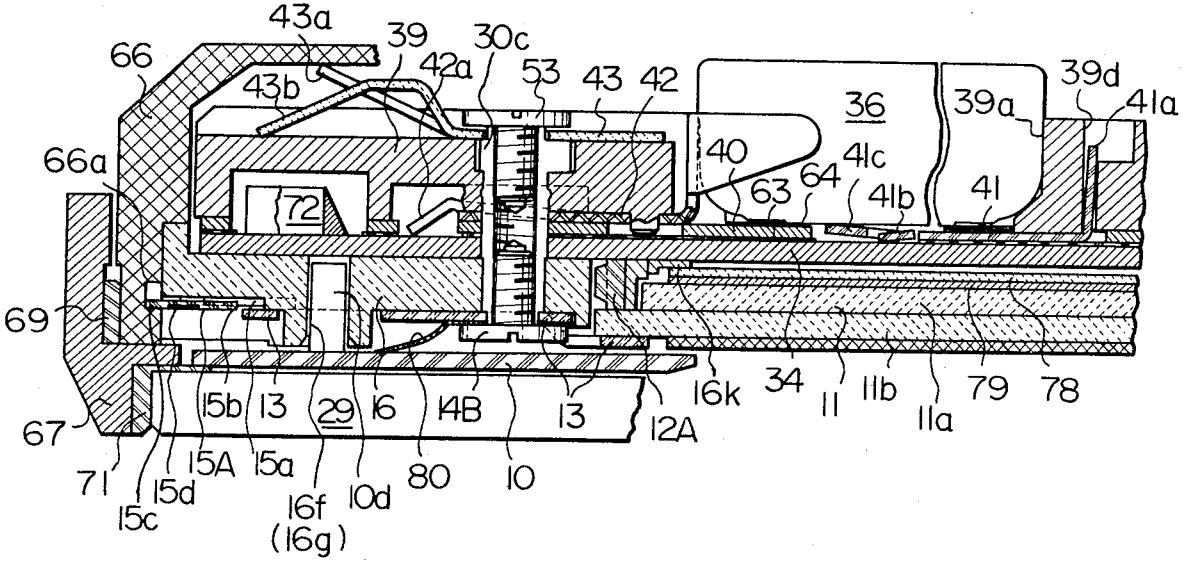
Figure 10:
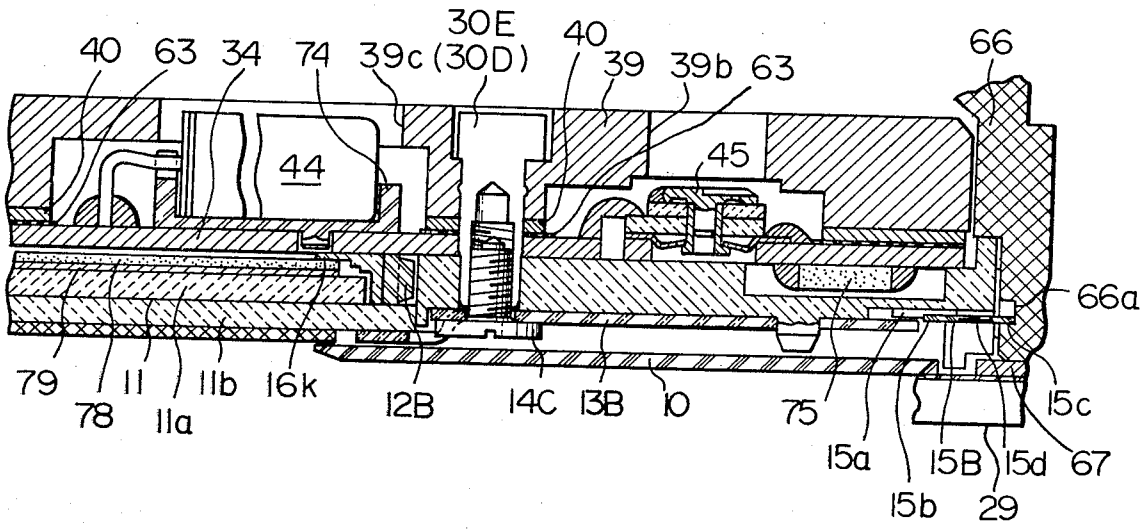
Figure 11:
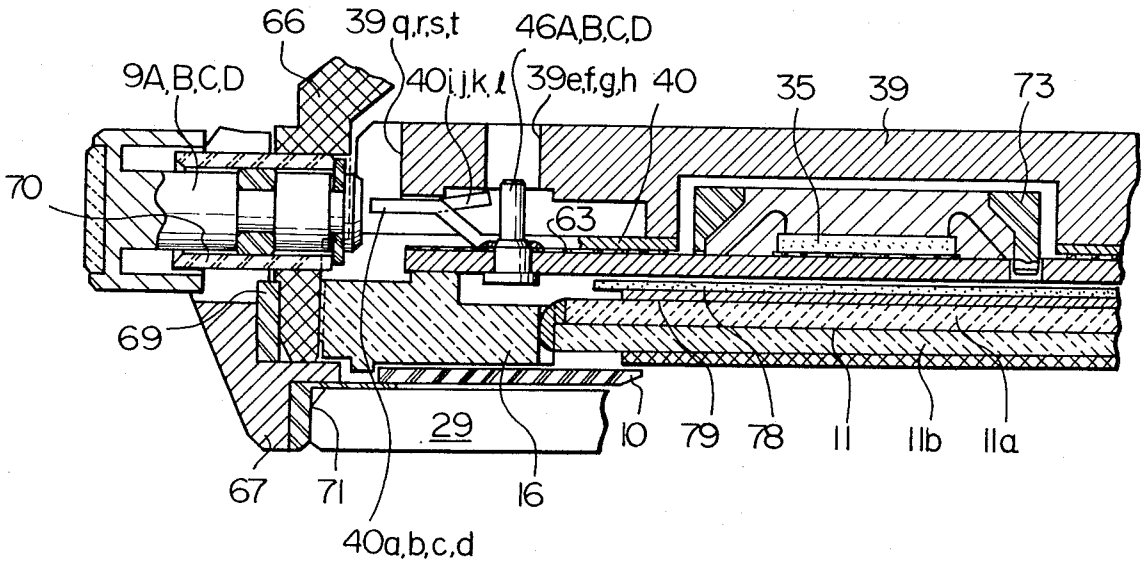

The battery retaining spring 41 is installed at the same time as the lateral pressure spring 42. The battery retaining spring 41 is composed of a positioning portion 41*a* that cooperates with the positioning hole 39*d* in the device cover 39, a spring portion 41*b* that makes contact with a pattern printed on the circuit board 34, the pattern being at a negative potential, and a contact spring portion 41*c* in contact with the battery 36, as shown in FIG. 9. The contact spring portion 41*c* has a spring force which is several times greater than that of the spring portion 41*b*, this being intended to preclude a loss of conductivity should the battery 36 experience a certain amount of leakage. In order widen both spring portions 41*b* and 41*c* to enlarge their spring force, a slit between them is made extremely narrow. This slit can be inexpensively formed by photo-etching to facilitate processing which has heretofore been complicated by a pressing step. Since spring portion 41*b* is bent downwardly and contact spring portion 41*c* upwardly, reliable contact pressure between these spring portions and the circuit board 34 and battery 36 is assured.

Next, a circuit support plate 40 is positioned and mounted by the tubes 30A through 30E. The circuit support plate 40 makes contact with the previously mounted lateral pressure spring 42 in the vicinity of the tube 30C and is therefore at a positive electric potential, the plate acting as a switch when a push-button 9 is depressed. More specifically, when an engaging portion 40*a* abutting against the push-button 9 is depressed, a spring portion 40*e* is deflected and makes contact with the switch terminal 46A secured by solder to the circuit board 34 which is mounted at a later step. This contact connects the switch terminal 46A to the positive potential to actuate the switch $S_1$. The push-button 9A can be depressed until it abuts against a stopper 39*q* provided on the device cover 39. This absorbs any variation in stroke as the switch spring portion 40*e* is deflected, and assures the contact pressure between the spring portion 40*e* and the switch terminal 46A. The spring portion 40*e* provides the restoring force for the push-button 9A, an advantage in terms of cost and case design since a push-button return spring such as a coil spring need not be provided at the side of the case. The construction of this switch portion for switch $S_1$ is adopted for all the switches $S_2$, $S_3$ and $S_4$. The engaging portions 40*b*, 40*c* and 40*d* corresponding to to the push-buttons 9B, 9C and 9D, the spring portions 40*f*, 40*g* and 40*h*, and the contact springs 40*j*, 40*K* and 40*l*, all of which have a complicated configuration, are formed in the common circuit support plate 40. The circuit support plate 40 has a complicated shape which further includes an access hole 40*m* for the battery retaining spring 41, an access hole 40*n* for a portion that mounts an IC chip 35, an access hole 40*g* for the quartz crystal vibrator 44, and an access hole 40*p* for the trimmer capacitor 45. A high grade photo-etching technique is used to precisely work the plate without bending. Another important furnction of the circuit support plate 40 is to receive impact load applied to the battery 36 to thereby prevent deformation of the circuit board 34 and fracturing of the liquid crystal cell 11. Thus, the signal circuit support plate 40, which serves as a reinforcing plate for receiving the impact load of the battery 36, is further provided with a switching function for the four switches and a return spring function for the push-buttons 9. This makes it possible to provide an inexpensive electronic timepiece which is excellent in design owing to the more compact, thinner and simpler module construction.

The circuit board 34 is installed after the circuit support plate 40 has been mounted. As the switch portions 40*e* through 40*b* of the circuit support plate 40 are movable, the entire surface of the wiring pattern on the circuit board 34 is covered with an insulating coating except for those portions of the wiring pattern which require to be exposed. However, to as sure reliable insulation an insulating sheet 63 is sandwiched between the circuit support plate 40 and circuit board 34. The insulating sheet 63 has approximately the same shape as the circuit board 34 and is made of a thin sheet of polyester, and is provided with an access hole for the battery retaining spring 41 as well as access holes for the IC chip 35, quartz crystal vibrator 44, trimmer capacitor 45 and other such component parts which are mounted on the circuit board 44.

The circuit board 34 cooperating with the circuit support plate 40 to sandwich the insulating sheet 63 is mounted on the device cover 39 and positioned by the tubes 30C, 30D and 30E. The IC chip 35 is connected to the top side (device cover side) of the circuit board 34 by wire bonding and is encapsulated by potting resin through the use of a frame 73 made of a heat-resisting plastic. The quartz crystal vibrator 44 is positioned by a plastic washer 74 and is fixed to the circuit board 34 by having its terminals soldered thereto. Also mounted on the circuit board by soldering are such component parts as the trimmer capacitor 45, five switch terminals 46A through 46E, two voltage boosting capacitor chips 72, and a resistor 75 for extending battery lifetime. Further, two coil terminal connection pins 62 are soldered to the circuit board 34 to serve as output terminals for the purpose of driving the transducer for the analog display section. Soldered on the two pins 62 is a coil terminal connecting sheet 60. The sheet comprises copper foil adhered to both sides of a resin film such as polyimide, the foil being formed into patterns by photoetching. Since the sheet is flexible it can be properly positioned by the tube 65A in the plate 32 even if there are some irregularities in planar or elevational positioning due to bending of the coil terminal connection pins 62, or errors in the mounting of the sheet 60, circuit board 34 or plate 32, etc. In installing the circuit board 34 in the device cover 39 a difficulty may arise in that the circuit board will float owing to the spring force of the spring 41*b* acting on the circuit board. This is compensated for by lightly pressing the tubes 30C and 30E into the circuit board.

The installation of the analog portion follows that of the circuit board 34. The analog portion is installed in the device cover 39 and positioned by the tubes 30A and 30B in the form of a block constructed by attaching a variety of component parts to the plate 32 by means of screws. The circuit support plate 40 is first installed by means of the tubes 30A and 30B, with the plate 32 then being superposed on and screwed to the plate 40 so that the plate 32 is at the same positive electric potential as the plate 40. Secured to the plate 32 by a screw 57 is a reset lever 56. When winding stem 20 is pulled out to place it in a state for rotation of the timepiece hands, the reset lever 56 is rotated by the setting lever pin 21*b* of setting lever 21 and comes into contact with switch terminal 46E soldered to circuit board 34, thus bringing the terminal 46E to the positive potential to actuate the switch. During this interval the analog output is interrupted and the counter for the analog output reset. Journalled between the plate 32 and wheel train bridge 31 are the center wheel and pinion 47, third wheel and pinion 48, fourth wheel and pinion 49, fifth wheel and pinion 50 and the rotor 51, the wheel train bridge 31 being secured to the plate 32 by two wheel train bridge screws 54A and 54B. A coil 58 for driving the transducer is secured by screws 55, 52 to two tubes 65A, 65B that are erected on the plate 32. A coil terminal sheet 59 is bonded to one end of the coil winding 58*a*. The abovementioned coil terminal connecting sheet 59 provided on the circuit board 34 is electrically connected to the coil terminal sheet 59 at the portion of the tube 65A. As in the case of the coil terminal connecting sheet 60 the coil terminal sheet 59 comprises a copper foil adhered to a resin film of polyimide or the like. Although the two overlapped sheets are secured by screws, it is difficult to obtain reliable contact between them over a long period of time because the screws tend to loosen owing to film resin creep and the fluidization of the bonding agent for the copper foil. A resilient coil terminal connecting washer 61 is therefore disposed below the coil terminal connecting screw 52 and is secured by tightening the screw. The washer 61 assures a reliable connection because its radially extending spring portion is bent downwardly and applies downwardly directed pressure on the connecting pattern portions on and between the sheets 59 and 60. In addition, the root portion 52*a* of the coil terminal connecting screw 52 defines a portion which is slightly larger in diameter than the diameter of the screw threads and which is not completely threaded. This portion is fitted into the hole of the coil terminal connecting washer 61 and is adapted such that the screw 52, once it has been tightened, is united with the washer 61 to form a unitary body which is easy to handle. The washer 61, which is small in size, would otherwise be difficult to handle and could be easily lost. The screw 52 mates with the tube 65A while sandwiching the washer 61 to prevent loosening, and assures a highly reliable connection for an extended period of time without the possibility of loosening due to vibration or the like and irrespective of the film resin creep and fluidization of the bonding agent between the coil terminal sheet 59 and coil terminal connecting sheet 60.

The coil terminal connection screw 52 is tightened from the device cover side after the circuit board 34 and analog block, namely the plate 32, are installed in the device cover. This is the reason for providing the access hole 39*p* in the device cover 39. In addition, the hole makes it possible to insert a probe for checking the output signals delivered to the coil 58 and permits the fifth wheel and pinion 50 to be observed.

Figure 6:
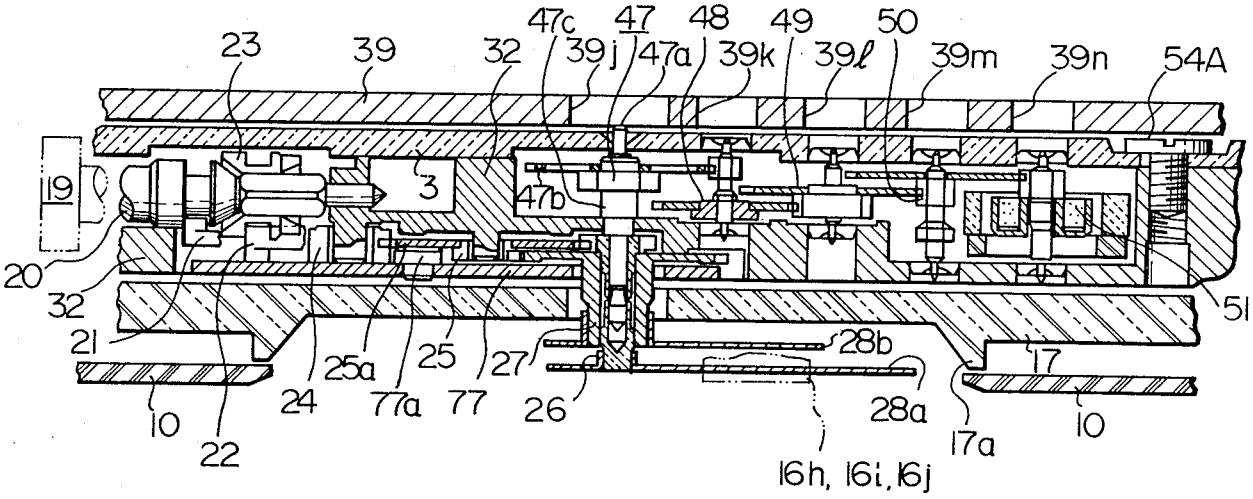
FIGS. 6, 7, 8, 9, 10 and 11 are cross-sectional views taken along the lines A—A, B—B, C—C, D—D, E—E and F—F, respectively, of FIGS. 4 and 5.
Figure 7:
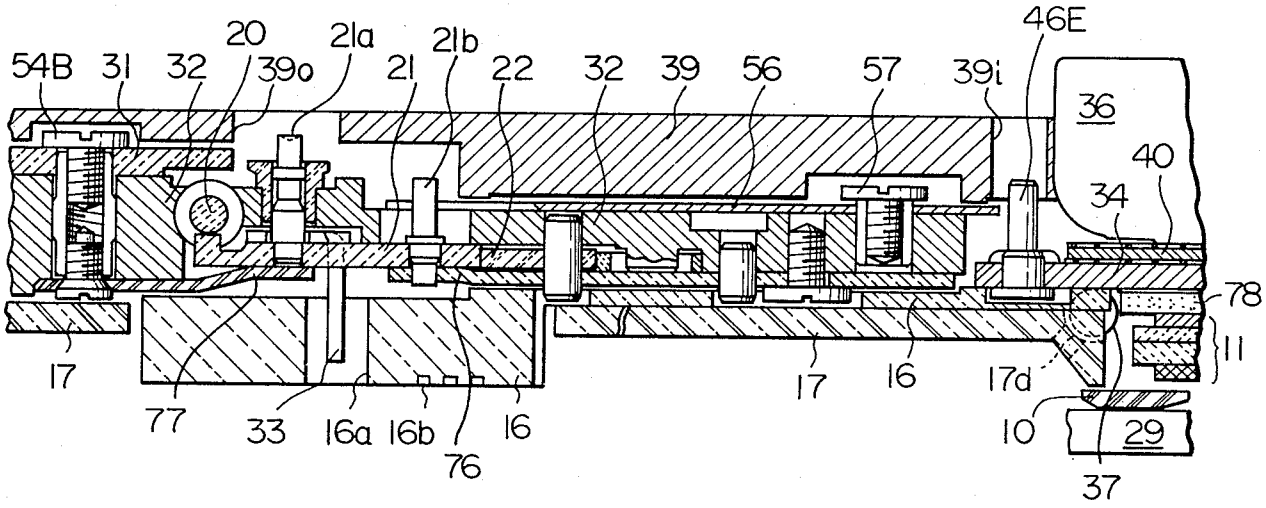
Figure 8:
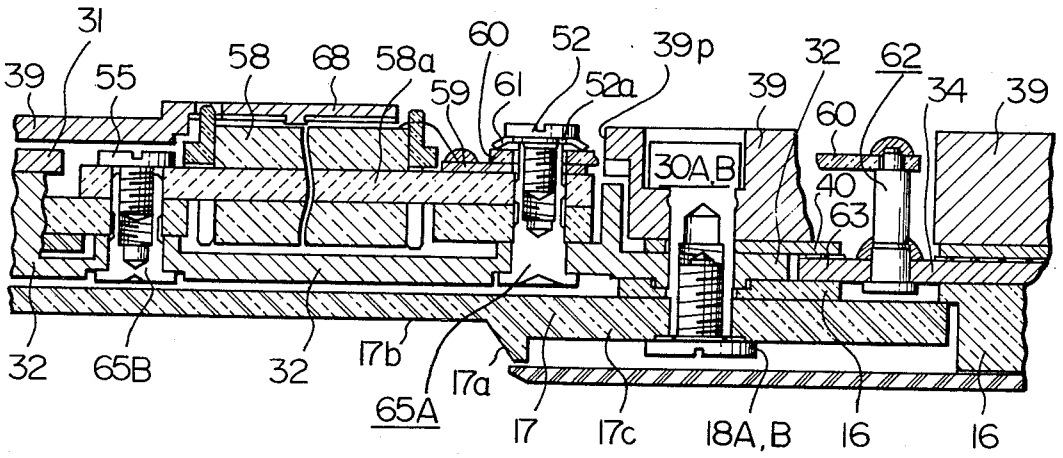

Other elements installed on the plate 32 are the so-called setting components of the timepiece. As shown in FIGS. 6 and 7, the winding stem 20, clutch wheel 23, clutch lever 22 and setting lever 21 are installed and then secured by the setting lever spring 76. A minute wheel spring 77 secures the installed setting wheel 24, minute wheel 25, cannon pinion 26 ahd hour wheel 27 which make up the setting wheel train. While the minute wheel gear 25*a* must be kept under pressure in order to prevent warping of the minute wheel 25, the gear 25*a* and hour wheel 27 are not located in the same plane. Warping of the minute wheel gear 25*a* is therefore prevented by implanting a rivet 77*a* in the minute wheel spring 77. As depicted in FIG. 4 the rivet 77*a* is provided at two locations on the side opposite hour wheel 27, the rivets 77*a* and hour wheel 27 cooperating to effectively suppress wobbling of the minute wheel gear 25 and prevent it from warping. Utilization of the rivets 77*a* provides better workability and higher accuracy then retaining minute wheel gear 25*a* by bending or drawings minute wheel spring 77.

One feature of the wheel train mechanism is the slip mechanism of the center wheel and pinion 47. In ordinary timepieces the cannon pinion or center wheel is provided with a slip mechanism in which a brake is applied to a portion of the wheel train when the crown is pulled out to set the hands, whereby rotation of such members as the cannon pinion and hour wheel is not transmitted to the rotor during the setting of the hands. The timepiece of the present invention, however, features a wheel train from which the brake has been eliminated. Consequently, the wheel train mechanism inclusive of the rotor 51 rotates when the hands are set. The brake has been omitted in view of the following considerations; (1) since the analog display is a two-hand display which does not have a second hand, there is no danger that the hands of the timepiece will shift or loosen when rotated at high speed; (2) a wear-resistant material is chosen for the shaft of the rotor 51 so that the shaft will not sustain wear even when the rotor is rotated at high speed; (3) the other gears and shafts in the wheel train do not sustain wear; and (4) the IC chip 35 and other electronic elements are not damaged or otherwise adversely affected, such as having their logic inpaired, by a back electromotive force generated in the coil 58 by the high-speed rotation of the rotor 51. Since the wheel train rotates along with the hands when the latter are set, the slip mechanism should, in essence, not be required. In the timepiece of the present invention, however, a slip mehcanism is provided between the cannon pinion 26 and center wheel stem 47*c*. This is intended to prevent the grinding of gears as well as gear face and shaft wear which would result from excess torque being applied to the setting portion of the wheel train such as clutch wheel 23, setting wheel 24 and minute wheel 25 due to inertia force that arises when attempting to suddenly rotate the wheel train from rest or in the direction opposite to that in which the wheel train is rotating. In other words, the purpose of this feature is to allow the cannon pinion portion to slip when an excessive inertia force results from suddenly starting or rotating the wheel train in the reverse direction. The slip mechanism associated with the cannon pinion, as shown in FIG. 6, can be replaced by a slip mechanism provided between the center wheel 47*b* and center wheel stem 47*c*. This would allow even greater stabilization of slip torque. In such a case the meshing between the center wheel stem 47*c* and cannon pinion 26 could be adjusted to a value higher than the slip torque of the center wheel 47*b*. This would simplify adjustment of torque.

Eliminating in the foregoing manner the braking of the wheel train at the time the hands are set simplifies the mechanism and hence enhances reliability and lowers cost. In addition, providing a portion of the wheel train with the slip mechanism prevents the setting wheel train from experiencing the grinding of gears as well as gear face and shaft wear that would otherwise be caused by sudden starting or reversal of the wheel train. This improves durability and reliability.

Once the analog block mounted on the plate 32 is installed in the device cove 39, a cel support frame 16 is positioned and attahced by the tubes 30A through 30E. The outermost circumference of the cell suprort frame 16 defines the outer diameter of the module and is fitted into a case band 66. While a clearance is provided between cell support frame 16 and plate 32 in order to absorb processing errors and facilitate assembly and workability, a portion of the clearance is filled by a large diameter portion 32*a* provided on the plate 32 at a portion thereof opposite the side pressed by the push-button 9C, that is, the portion of the plate in the vicinity of the winding stem 20. Since the cell support frame 16 is low in strength adjacent the frame 32, the above expedient prevents poor switch operation (insufficient stroke) caused by displacement of the entire module in the case due to deformation of the frame 16 when the push-buttons are depressed. Thus, partially narrowing the clearances between such components as the plate 32 and circuit board 34 as well as between the cell support frame 16 and device cover 39 on the sides opposite the push buttons makes is possible to preclude poor switch operation due to insufficient stroke by allowing the plate 32 and circuit board 34 to reinforce the strength of the module components such as the cell support frame 16 and device cover 39. This is accomplished without impairing the ease of assembly. Support frame 16 is made of plastic formed by monolithic molding and includes cavities for connectors 12A and 12B, a first recess or positioning portion for the liquid crystal cell 11, a second recess for the time indicating hands, positioning bosses 16*c*, 16*d* and 16*e* for keep springs 13A and 13B, masking plate positioning holes 16*f* and 16*g*, and an access hole 16*a* for manipulating a lever 33 for mounting and demounting the winding stem. Moreover, projections 16*h*, 16*i* and 16*j* project beyond the dial 17 and the end of cannon pinion 26 so that the dial 17 or hands 28*a*, 28*b* will not be rubbed or struck when the display side is faced downward, even if the module is placed in position. This facilitates handling.

Positioned and mounted in the cell support frame 16 after its installation are the connectors 12A, 12B and a reflector 78 equipped with a light guiding plate. Thereafter the liquid crystal cell 11 is installed. Since the cell is irregular in shape the keep spring 13A disposed along its upper edge is long in length and secured by two screws 14A, 14B, while the keep spring 13B disposed along its lower edge is short in length and secured by a single screw 14C, this arrangement being adopted to prevent an imbalance in the retaining force. The way in which the cell is retained to maintain satisfactory balance is very important in preventing cracking of the glass plates in the cell as would be caused by an impact load or the like. This is because the liquid crystal cell 11 is irregularly shaped and therefore has only $\frac{1}{2}$ to $\frac{1}{3}$ the strength of the customary rectangular cell or rectangular cell whose corners have been cut off.

Module keep plates 15A, 15B are disposed below the cell keep springs 13A, 13B and are pressed thereby. These module keep plates 15 serve to fix the module within the case band 55 and comprise a pressing portion 15*a* divided into two members each of which is bent downward at the root portion as viewed from the bottom and urged by the cell keep spring 13, a stopper portion 15*b* adapted so as not to slide under the cell keep spring 13 when the module is being mounted in the case, an engaging portion which engages with a groove 66*a* located inside the case band 66, and an operation portion 15*d*. To remove the mounted module from the interior of the case band 66 the operation portion 15*d* of the module keep plate 15 is depressed by tweezers or the like to downwardly urge the stopper portion 15*b*. Then, once the cross-sections of the cell keep spring 13 and stopper portion 15*b* no longer overlap, the stopper portion 15*b* is slid in the direction of the arrow and caused to slide under the cell keep spring 13 detach the engaging portion 15*c* from the groove 66*a* in the case band 66. This operation is an extremely easy one to practice and is further facilitated by the PUSH & SLIDE instruction printed on the cell keep spring 13B. When installing the module in the case band 66 the operation portion **15*d* is pushed and slid in the direction opposite to that of the arrow until the stopper portion 15*b* slides out from under the cell keep spring 13, thereby bringing the engaging portion 15*c* into engagement with the groove 66*a* in the case band 66. While the arrow configuration on the operation member 15*d*** can be formed by half-etching or printing or other such technique, half-etching allows the arrow to be formed to a depth which is approximately 60% that of the plate thickness so that the tool such as the tweezers used to slide the module keep plate will readily engage with the arrow during the slinding operation and hence facilitate the same. If a pressing technique is used it is difficult to deepen the arrow to the extent allowed by etching, and a protrusion is likely to be formed on the opposite side of the plate if it is pressed too deeply. These disadvantages would necessitate an increase in the number of processing steps, whereas the etching technique allows processing to be accomplished at the same time as the shaping of the outside configuration, and advantage in terms of cost as well.

Module keep plate 15A is located at the 12 o'clock position and module keep plate 15B at the 4 o'clock position, a distribution which, together with the crown 19 at the 8 o'clock position, provides a spacing of approximately 120 degrees and allows the module to be secured in the case band 66 in a balanced manner. In addition, the module is secured against rotational movement in the case band 66 by the crown 19 so that rotational positioning of the module can be accurately achieved with relative ease.

The analog blcok mounted on the plate 32 sandwiched between device cover 39 and cell support frame 16 is fixed to the device cover 39 together with the dial 17 by tightening the screws in tubes 30A, 30B. Using the same tubes and screws for this purpose provides accurate positioning, a reduction in component parts, and simplifies the assembly operation.

After the dial 17 is secured by tightening the screws, the hands **28*a*, 28*b* are attached. The module is then encased. The upper surface of the dial 17 is positioned to be lower than the upper portion of the display cell 11 such that the time indicating hands are aligned on the same plane as the upper portion of the display cell. Thus, after the module has been inserted in the case band 66, it is secured in the case band by the two module keep plates 15A, 15B as described above. Thereafter, the masking plate 10 is attached to the module by inserting its legs into the two positioning holes 16*f*, 16*g* located in the cell support frame 16. Finally, the bezel 67 is placed on the case band and pressed to compress packing 69 and hence provide a fixing force. The crystal 29 has already been mounted in the upper case band using a crystal packing 71**. This completes the entire assembly operation.

A battery keep spring 43 has a pressing portion **43*b* that presses the battery 36 and prevents it from springing out due to the spring force of battery retaining spring 41 during the assembly and inspection of the module up until it has been installed in the case. However, in order to facilitate replacement of the battery 36 through a battery hatch (not shown) once the module has been installed in the case, the pressing portion 43*b* is rotated about tube 30C to remove it from the battery and place it on the device cover 39, as is shown in FIGS. 5 and 9. Battery keep spring 43 also has a spring portion 43*a* which is bent upwardly. With the module installed in the case the spring portion 43*a* contacts the case band 66 and places the case band 66 at the positive potential of battery 36 via the battery lateral pressure spring 42 and tube 30C or screw 53. This is useful in protecting the module against static electricity, as will be described later, and is achieved without any increase in component parts by providing the spring portion 43*a* on a portion of the battery keep spring 43** which is employed only during such operations as assembly and inspection of the module.

The electronic timepiece of the present invention has a number of additional features which can be mentioned. The liquid crystal cell 11, unlike the conventional rectangularly shaped cells or rectangular cells whose corners have been removed, has an irregular shape with a portion cut out to form a corner portion **11*a* which describes an obtuse angle, as illustrated in FIG. 4. The dial 17 of the analog portion is disposed in the corner portion 11*a* of the liquid crystal cell 11**, thus affording a unique design in which the analog and digital displays seem to be integrated into a single display.

The arrangement wherein the dial 17 is disposed at the lower, left-hand side of the timepiece, with the 12 o'clock position being at the top (in FIG. 4 the dial 17 is shown at the lower right since the orientation of the drawing has the 3 o'clock position at the top), is adopted in view of the following considerations. Namely, when the first two digits in the upper frame **10*a* of the digital display indicate "hours" and the second two digits indicate "minutes", "seconds" are read in the lower frame 10*b*. Further, when the month and date is displayed in the upper frame 10*a*, the day of the week is read in the lower frame 10*b*, and when "minutes" and "seconds" are displayed in the upper frame 10*a*, "1/100" of a second appears in the lower frame 10*b*. Thus, in consideration of the flow of time, the inter-relationship of the displays as well as ease of understanding, the most preferred arrangement has the display in the lower frame 10*b* of liquid crystal cell 11 positioned below the display of the last two digits in the upper frame 10*a*** of the cell.

In consequence, the analog display frame **10*c* occupies the lower left-hand portion (the 8 o'clock position) of the module. The analog movement is disposed beneath the bottom surface of dial 17, as can be seen in FIG. 4, and the crown 19 serving as the external operation member of the analog correction section is provided at the 8 o'clock position of the timepiece. Although the crown is generally located at the 3 o'clock position to facilitate its operation, in the present invention it is located at the 8 o'clock position because it is then more readily apparent that the crown is associated with the dial 17 is view of its proximity thereto, and because of structural considerations wherein the winding stem 20 would have to be passed through the digital portion in order to provide the crown at the 3 o'clock position, this following from the fact that the analog movement is located at the lower right-hand side of the module. As a result, the crown 19** must be operated by the left hand or by the right hand after the left wrist has been turned to invert the timepiece display. While this does pose some inconvenience, operability is not seriously impaired since the crown is used only seldomly, such as when making an initial setting or correcting for time differences, when traveling abroad, this being the case because the timepiece relies on a quartz crystal vibrator so that time corrections are generally zero reset operations with the zero reset of the analog display being linked to that of the digital display. It is much more preferable to locate a correction member in the proximity of its associated display section so that the correction member can be operated without confusion while its function is readily understood. Moreover, in view of module design it is the least troublesome expedient, and one which contributes to a thinner and more compact timepiece, to dispose the crwon, which is the member for mechanically correting the analog section, at that portion of the module perimeter where the analog movement is located.

Winding stem 20 located at the 8 o'clock position points toward the center of the module. Hence, the center of dial 17, namely the coordinates of cannon pinion 26 and hour wheel 27 that mount minute hand 28*a* and hour hand 28*b*, is not located on a line extended from the winding stem 20. Consequently there is little restriction upon the stroke of the winding stem, thereby making it possible to obtain a large stem stroke. This facilitates the designing of the so-cell setting portion.

Dial 17 is fastened by the two screws 18A, 18B and includes a projecting portion 17*a* along the hexagon-shaped analog display frame 10*c*. A recessed portion 17*b* surrounded by the projecting portion 17*a* defines the space in which the hands of the timepiece rotate. Minimizing the thickness of this portion of the dial 17 to as great an extent as possible provides a large clearance for the hands 28*a*, 28*b* so that the hands are not impeded by rubbing against each other or the dial, etc. On the other hand, as extended portion 17*c* located outside the projecting portion 17*a* is thickened since it is not the portion where the hands 28*a*, 28*b* are mounted. As it is difficult to form the dial 17 by mechanical processing owing to its complicated shape, it is necessary to rely upon the molding and working of plastic or the electroforming and working of a metal such as copper. Accordingly, in view of shaping, warkability and strength it is important that the abovementioned portion of the dial 17 be thickened even if only to a slight extent. In particular, the fact that the screws 18A, 18B which secure the dial 17 are comparatively far apart makes thckening the hexagonal projecting portion 17*a* and extended portion 17*c* an extremely effective expedient for prevention of dial deformation due to impact sustained when the timepiece is dropped.

Dial 17 is positioned by the two tubes 30A, 30B pressed into the device cover 39. These tubes also serve to position the plate 32 of the analog movement so that there is littl error involved in the mounting of the dial 17. Moreover, in contrast to the most widely employed conventional method wherein a dial is provided with legs that are secured by side screws, the present invention has a number of major advantages in that it eliminates dial mounting errors resulting from errors involved in the bending and mounting of dial legs as in the prior art, and in that a plate processing step for side screws can be omitted.

The manipulation of the lever 33 for mounting and demounting winding stem 20 is conducted through the hole 16*a* provided in the cell support frame 16. In general practice the operation portion of the lever is disposed at the outermost side of the module with the resule that the lever rotates and strikes the case when the case receives the module during installation. In the timepiece of the present invention the lever 33 is limited to a position within the hole 16*a* of the cell support frame 16, thereby affording good operability and greatly facilitating installation of the module into the case. Even an individual not accustomed to handling the mechanism can readily understand its operation thanks to a PUSH instruction, which explains how the lever 33 is manipulated, engraved on the display portion 16*b* of the cell support frame 16 adjacent the hole 16*a*.

Unlike the ordinary liquid crystal display cells which define a rectangle or a rectangle whose corners have been removed, the configuration of the liquid crystal cell 11 is such that its two upper corners are cut off while a portion of the cell is cut out to form the corner portion 11*a* at the lower left, the corner portion defining an obtuse angle. The connector 12B along the lower edge of the cell therefore has approximately half the length of the connector 12A along the upper edge, both connectors being disposed toward the right-hand side of the cell. IC chip 35, mounted on the bottom surface of circuit board 34 whose outer periphery approximately agrees with that of liquid crystal cell 11, is disposed off-center closer to the right-hand side of the cell in order to simplify the wiring between the chip and connectors 12A, 12B to the greatest possible extent. Specifically, as over 80% of the terminals on the IC chip 35 are for the purpose of driving the liquid crystal cell 11, simplification of the associated wiring has a direct bearing on simplifying all the wiring on the circuit board 34.

Battery 36 is disposed beneath the liquid crystal cell 11 on the left-hand side in order to avoid stacking of the battery and IC chip 35.

The liquid crystal cell 11 having the irregular shape best illustrated in FIG. 4 has only about ½ to ⅓ the strength, with regard to cracking of the glass plates, of the ordinary rectangular cell or rectangular cell whose corners have cut off. Liquid crystal cell 11 is particularly poor in strength in the vicinity of the irregularly shaped corner portion 11*a*. Moreover, the battery 36 is disposed exactly at this portion of the cell that is weak in strength. When the battery 36 receives an impact applied from the display surface side its impact load deforms the circuit support plate 40 and the circuit board 34. While increasing the strength of the circuit support plate 40 which is intended to receive the impact load of the battery 36 would be effective in countering cracking of the liquid crystal cell, the planar configuration of the support plate is almost entirely decided by the arrangement of the components mounted on circuit board 34, and thickening the support plate would greatly complicate its processing owing to the complex arrangement of fine spring portions and narrow slits which it possesses. Thickening the support plate would also increase the thickness of the module. Although another effective measure against cracking of the liquid crystal cell 11 would be to widen the clearance between the circuit board 34 and reflector 78 such that deformation of the circuit board would not affect the cell, obtaining a clearance of sufficient width would necessitate thickening module to a considerable extent and therefore would be a major obstacle to obtaining a slender module of superior design. In view of these considerations the electronic timepiece of the present invention utilizes the dial 17 to prevent deformation of circuit board 34 owing to the impact load of the battery 36, as shown by the arrangement depicted in FIG. 7. More specifically, dial 17 is disposed beneath circuit board 34 with the cell support frame 16 sandwiched therebetween. Then, the gap is narrowed between masking plate 10 and the edge of the projecting portion 17*a* of dial 17 to the maximum possible extent that will still allow variations in component precision to be absorbed in order to make installation in such a case possible. Hence, when the impact load of battery 36 is about to deform circuit board 34, the arrangement is such that the crystal 29 precludes such deformation via cell support frame 16, dial 17 and masking plate 10. The crystal is firmly secured in bezel 67 by the packing 71 and therefore experience almost no deformation or displacement attributable to the impact load of the battery. The result is that cracking of the liquid crystal cell due to impact can be prevented even if the clearance between the reflector 78 and circuit board 34 is an extremely small one.

It is necessary that the clearance between reflector 78 and circuit board 34 be at least as large as the clearance between dial 17 and masking plate 10, but masking the clearance unnecessarily large would increase the thickness of the module and hence impair its attractive, slender design. To this end a portion of the cell support frame 16 is lengthened to form a portion 16*k* for regulating the height of the liquid crystal cell 11, as shown in FIG. 9. Thus, it is possible to establish the minimum necessary clearance between reflector 78 and circuit board 34 since the clearance is essentially decided by the thickness of the portion 16*k*. The portion provided with the regulating portion 16*k* is disposed close to the tubes 14A, 14B, 14C that secure the circuit board 34 and circuit support plate 40, this position experiencing little deformation due to battery impact load. In addition, the reflector 78 and lower polarizing plate 79 are interposed between the portion 16*k* and the lower glass plate 11*a* of the liquid crystal cell 11 and act as a buffer even if the portion 16*k* is subjected to the impact load of the battery 36 via the circuit support plate 40 and circuit board 34. This is useful in improving the resistance of the cell against cracking.

A lamp 37 is disposed approximately at the center of the module in the vicinity of the corner portion 11*a* forming the cut-out portion of the liquid crystal cell 11. This position is the most advantageous for allowing the light from the lamp to illuminate substantially the entire surface of the liquid crystal cell 11, and permits the uniform illumination of the right and left sides of the liquid crystal display in upper display frame 10*a* as well as the uniform illumination of the liquid crystal display portions in upper display frame 10*a* and lower display frame 10*b*. Moreover, since lamp 37 is disposed at a height to make it level with the dial 17, it is possible to similtaneously illuminate the analog portion by selecting a dial material that has a light guiding property.

It providing the dial 17 with a light-guiding effect is not possible because of design limitations, the analog portion can be made readable in a darkened environment by boring a hole 17*d* through a portion of the dial to permit the light from the lamp to exit upon the surface of the dial. This arrangement and positioning of the lamp is extremely convenient, especially for viewing the hour hand 25*b*, since the analog display comprising the dial 17 and hands 28*a*, 28*b* can be read with very little light as compared with the liquid crystal cell 11, and because the lamp 37 is located in the vicinity of the 12 o'clock and 1 o'clock positions, that is, in the vicinity of that portion of the dial corresponding to mid-night. Such positioning is practical since the lamp 37 is generally used at night.

Figure 12:
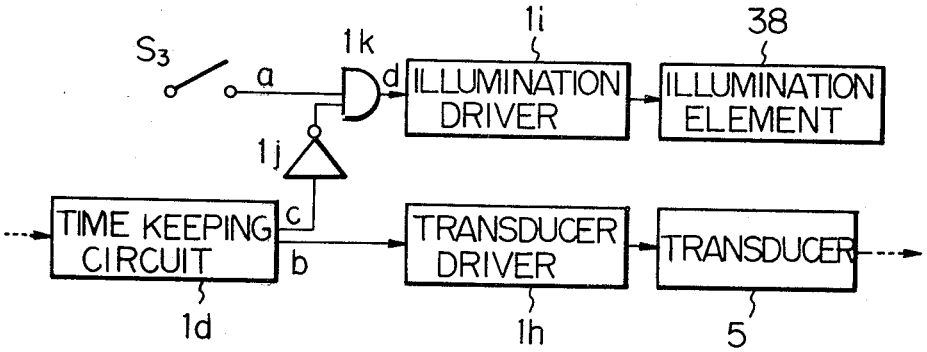
FIG. 12 is a block wiring diagram showing the relationship between driving illumination means and driving a transducer.
Figure 13:
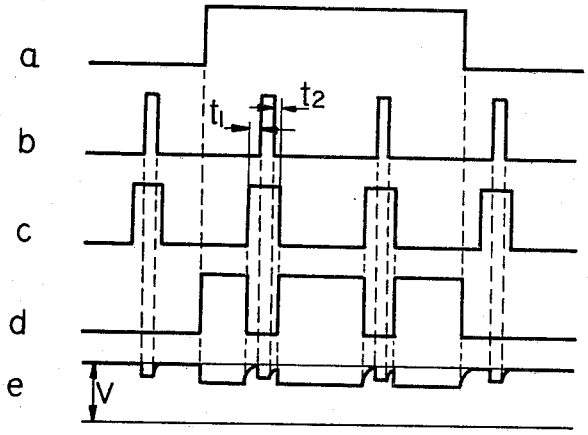
FIG. 13 is a timing chart showing the principal voltage waveforms associated with the circuitry of FIG. 12.

In addition to lamp 37 electroluminescent means or the like can also be employed to illuminate the timepiece. However, either alternative places a considerable load on compact, button-type batteries and causes no small drop in battery voltage when lit. In consequence, there is the danger of a miscount (erroneous transducer operation) in driving the transducer of the analog display, particularly if the lamp is lit when the internal resistance of the battery is high and the ambient temperature low. It has therefore been contrived to avoid overlapping of output signals delivered to the illumination means and transducer, as shown in FIGS. 12 and 13. Time-keeping circuit 1*d* delivers a signal b to the transducer driver circuit 1*b*, and simultaneously delivers a signal c to an AND gate 1*k* through an inverter 1*j*. During internals over which the signal c is a logic "1", that is, when the pulses of signal b are being applied to the transducer driver circuit 1*h*, the gate 1*k* does not deliver an output pulse to a driver circuit 1*i* for illumination even if the switch $S_3$ is closed. The lamp 37 or an electroluminescent illumination element 38 therefore will not light. It would be desirable if the power source voltage, when it is experiencing a voltage drop due to actuation of the illumination means, could be furnished beforehand with recovery time in anticipation of the pulses to be delivered to the transducer. This is accomplished by allowing the pulses which the time-keeping circuit 1*d* applies to the inverter 1*j* to slightly lead the pulses which the transducer driver circuit 1*h* delivers to the transducer 5. When switch $S_3$ is closed a signal a is fed to AND gate 1*k*. On the other hand, the time-keeping circuit 1*d* delivers the signal b to the driver circuit 1*h*. The signal b has a frequency of 1 Hz if a second hand is advanced at one-second intervals, or a frequency of $\frac{1}{4}$ Hz if the second hand is advanced at 4-second intervals, the pulse width therefore lying between 3 and 10 msec. The signal c is in synchronism with the signal b but has a wider pulse width, the leading edge of signal c leading that of signal b by $t_1$ while its trailing edge lags that of signal b by $t_2$. Signal c is applied to AND gate 1*k* through inverter 1*j*. The output signal from AND gate 1*k* has the waveform d and is applied to driver circuit 1*i* to intermittently drive the illumination element 38. The time intervals $t_1$, $t_2$ indicative of the difference in pulse width between the transducer drive signal b from time-keeping circuit d and the lamp control signal c depend on the characteristics of the power source. In other words, when a pulse in the transducer drive signal b is about to be generated during the interval that the lamp is lit, a pulse in the lamp control signal c which leads the transducer drive signal b by $t_1$ is fed beforehand to the driver circuit 1*i* for illumination to thereby turn off the illumination element 38. The power source voltage e which has experienced the voltage drop owing to its internal resistance therefore returns to the normal battery voltage V, after which the transducer dirve signal b emerges from the time-keeping circuit. The illumination element 38 again lights after the passage of time $t_2$ required for the power source voltage, which has dropped owing to driving of the transducer, to return to the vicinity of the normal level V. This arrangement prevents a large drop in power source voltage, a miscount in the trnsducer, as well as errors in the counters and memory of the IC chip. Such phenomena are attributable to overlapping of the voltage drop due to illumination and the voltage drop resulting from driving the transducer. In the case of miniature silver batteries that are generally employed in timepieces, the voltage drop when the timepiece is being illuminated and the transducer drived is approximately 0.1 to 0.3 V, and the recovery time is serveral milliseconds. In cases where the recovery time can be virtually neglected, $t_1$, $t_2$ are equal to zero, i.e., it suffices if the converter drive signal b and lamp control signal c have the same pulse width.

Another method of avoiding the overlapping of the analog and illumination outputs is to interrupt the analog output during the illumination output, during which time the number of interrupted analog output pulses is stored in a counter and then retrieved to advance the transducer by the number of counter pulses at a high rate of speed after the illumination element has been turned off. According to this method, however, the hands of the timepiece are at rest during the period of illumination so that the time cannot be accurately read on the analog display when the lamp is lit. Even if a certain illumination interval is anticipated and the counter designed accordingly, the time display is likely to be disturbed if the lamp is lit for a period of time in excess of the anticipated period. These are some of the disadvantages encountered in the above method. By contrast, the method of FIG. 12 which interrupts the lamp output while the transducer is being driven does not affect the reading of the time to a detrimental extent, the display being caused to darken only once per second or once, momentarily, every several seconds.

There are occasions when the timekeeping accuracy and display of an electronic timepiece are disturbed due to the influence of externally applied static electricity. A wristwatch encounters such static electricity rather often, as when putting on or taking off clothing, or when the watch is shipped in a plastic case. A digital electronic timepiece having a liquid crystal display is particularly susceptible. In the electronic timepiece of the present invention, the masking plate 10 and case band 66 serve to shield the module against static electricity. As illustrated in FIG. 9, case band 66 is placed at the positive potential of battery 36 via the spring portion 43*a* of battery keep spring 43, the tube 30C or screw 53, and the battery lateral pressure spring 42. Masking plate 10, which is made of metal, is likewise placed at the positive battery potential via a masking plate contacting spring 80, screw 14B, tube 30C, and battery lateral pressure spring 42. Thus, using the same component part for several purposes and adding a number of simple component parts allows the periphery of the module to be shielded, an extremely effective expedient to improve the timepiece resistance against external static electricity.

What is claimed is:

1. A watch module construction for an electronic timepiece powered by a battery, comprising:

a digital display device composed of a liquid crystal display cell being of a polygonal profile in plan, with one internal angle of said profile being in the range 180 degrees to 360 degrees;

an analog display device composed of time indicating hands;

a base plate;

a circuit board disposed substantially on the same plane as said base plate;

a cell support frame disposed on one side of each of said base plate and said circuit board, said cell support frame having a first recess in which said liquid crystal display cell is disposed, and a second recess in which said time indicating hands are disposed;

an IC chip mounted on the other side of said circuit board in substantially axial alignment with said display cell;

a wheel train bridge mounted on the other side of said base plate to provide an axial space between said wheel train bridge and the other side of said base plate at an area substantially in axial alignment with said time indicating hands; and a wheel train mechanism disposed in said axial space between said wheel train bridge and said base plate.

2. A watch module construction according to claim 1, further comprising a dial disposed in said second recess and secured to said cell support frame, said dial having its upper surface lower than an upper portion of said liquid crystal display cell such that the time indicating hands are aligned substantially the same plane as the lower portion of said liquid crystal display cell.

3. A watch module construction according to claim 2, further comprising a masking plate having a plurality of legs secured to said cell support frame and including a plurality of openings for said digital display device and said analog display device.

4. A watch module construction according to claim 1, further comprising first external operation means for altering the display content of said analog display device, and second external operation means for altering the display content of said digital display device, said first external operation means being disposed in the vicinity of said analog display device.

5. A watch module construction according to claim 4, in which said first external operation means comprises a crown which is disposed at a lower left-hand side of said base plate.

6. A watch module construction according to claim 4, in which said second external operation means comprises a plurality of push-buttons which are disposed about an outer periphery of said digital display device except at a position occupied by said analog display device.

7. A watch module construction according to claim 1, in which said digital display device comprises a first display section formed at a first area of said liquid crystal display cell to provide a display of hours and minutes information, and a second display section formed at a second area of said liquid crystal display cell to provide a display of seconds information.

8. A watch module construction according to claim 7, in which said time indicating hands comprise an hours hand and a minutes hand.

9. A watch module construction according to claim 2, further comprising a device cover disposed over said base plate and said circuit board and secured to said cell support frame.

10. A watch module construction according to claim 9, in which said device cover has a battery retaining hole formed at a position to be in axial alignment with said digital display device and said analog display device such that said battery retained in said battery retaining recess is out of axial alignment with said wheel train mechanism.

11. A watch module construction according to claim 7, furthwer comprising a quartz crystal vibrator which is mounted on the other side of said circuit board at a position in axial alignment with said second display section.

12. A watch module construction according to claim 9, in which said dial is secured to said device cover in such a manner that said cell support frame and said base plate are interposed between said dial and said device cover.

13. A watch module construction according to claim 9, further comprising an electro-mechanical transducer including a driving coil which is disposed between said base plate and said device cover 14. A watch module construction according to claim 13, further comprising a shielding plate which is disposed between said driving coil and said device cover and secured to said device cover.

15. A watch module construction according to claim 9, further comprising a switch contact secured to said circuit board at a position adjacent to said base plate, and a reset lever is rotatably supported on the other side of said base plate, said reset lever having its one end engageable with said switch contact when said reset lever is actuated.

16. A watch module construction according to claim 3, in which said dial has a prescribed outer periphery and an axially extending projection formed around said prescribed outer periphery to prevent said masking plate from contacting an upper surface of said liquid crystal display cell when said masking plate is subjected to external forces.

17. A watch module construction according to claim 10, further comprising a battery retaining spring including a switch contact portion and held in contact with a positive terminal of said battery, said battery retaining spring is electrically connected to said base plate.

* * * * *